US009207041B1

(12) United States Patent
Bast

(10) Patent No.: US 9,207,041 B1
(45) Date of Patent: Dec. 8, 2015

(54) MAGAZINE WELL GRIP

(71) Applicant: Peter W. Bast, Lake Worth, FL (US)

(72) Inventor: Peter W. Bast, Lake Worth, FL (US)

( * ) Notice: Subject to any disclaimer, the term of this patent is extended or adjusted under 35 U.S.C. 154(b) by 0 days.

(21) Appl. No.: 14/627,449

(22) Filed: Feb. 20, 2015

(51) Int. Cl.
*F41C 23/16* (2006.01)

(52) U.S. Cl.
CPC ..... *F41C 23/16* (2013.01)

(58) Field of Classification Search
CPC ..... F41C 23/16; F41C 23/12
USPC ..... 42/90, 7, 72, 6
See application file for complete search history.

(56) References Cited

U.S. PATENT DOCUMENTS 7,823,312 B2 * 11/2010 Faifer ..... 42/49.02
8,533,987 B2 9/2013 Rogers et al.
8,590,201 B2 * 11/2013 Brixius ..... 42/71.01
8,726,554 B2 * 5/2014 Klassen ..... 42/6
2012/0073176 A1 * 3/2012 McManus et al. ..... 42/6
2013/0180143 A1 * 7/2013 Delgado Acarreta ..... 42/1.02
2013/0269231 A1 * 10/2013 Pietrzyk ..... 42/6
2014/0331535 A1 * 11/2014 Robinson et al. ..... 42/6

* cited by examiner

*Primary Examiner* — Reginald Tillman, Jr.
(74) *Attorney, Agent, or Firm* — Patents on Demand P.A.; Brian K. Buchheit; Scott M. Garrett

(57) ABSTRACT

A magazine well grip is configured to be self-retained on the front portion of the magazine well of the lower receiver for an AR type rifle or pistol. The magazine well grip includes a body that generally tapers outward from top to bottom, and includes a rib on an inner surface to contact the magazine well and maintain space between the magazine well and the inner surface of the magazine well grip. At least some of the ribs include an integrally formed retaining feature for engaging the lip of the magazine well which, in conjunction with a retaining tang that protrudes from the top of the body to engage a hinge pin boss, operates to retain the magazine well grip on the magazine well.

20 Claims, 7 Drawing Sheets

MAGAZINE WELL GRIP

BACKGROUND

The AR rifle platform is used for many variations of rifles for both military and sporting applications, and was originated by the Fairchild Armalite corporation (hence "AR") in the late 1950s. It has since been produced in several different variations and calibers. One military variant, the M4 carbine, is a standard issue rifle for troops, and includes a select fire or fully automatic fire capability. Conversely, most civilian AR rifle variants are limited to semi-automatic fire capability. One prominent characteristic of the AR rifle is the magazine well. The magazine well is formed in the lower receiver in front of the trigger, and protrudes downward from the top portion of the lower receiver, where it mates with the upper receiver, and includes features for retaining a magazine so as to feed ammunition into the action contained in the upper receiver.

Although AR rifles typically have a handguard located along the barrel of the rifle, forward of the upper and lower receivers to allow an operator to hold the rifle with their non-trigger arm, operators often find it convenient to place their non-trigger hand on the front of the magazine well. This is especially true for certain shooting maneuvers that require quickly redirecting the rifle (e.g. "close quarters battle," or CQB, sport shooting events, etc.). Holding on the front of the magazine well shortens the effective pivot radius at which the forward hand drives the aim of the rifle. However, holding the rifle at the front of the magazine well is thought to be a potential source of operating issues with the rifle, particularly with ammunition feeding properly from the magazine into the action. It is thought that rearward pressure from the hand on a magazine, when holding the front of the magazine well, can cause some magazines to tilt or cant in the magazine well to an extent that the topmost cartridges in the magazine are not properly aligned when the bolt cycles. As a result, miss-feeds can occur as the bolt cycles forward, preventing chambering of the cartridge, and requiring the operator to clear the malfunction, losing time and a round of ammunition in the process.

Accordingly, there is a need for way to allow operators to grip at the location of the front of the magazine well without potentially inducing cartridge feeding issues that can otherwise occur in AR rifles while allowing servicing of the rifle.

BRIEF DESCRIPTION OF THE FIGURES

In the accompanying figures like reference numerals refer to identical or functionally similar elements throughout the separate views, together with the detailed description below, and are incorporated in and form part of the specification to further illustrate embodiments of concepts that include the claimed invention and explain various principles and advantages of those embodiments.

Figure 1:
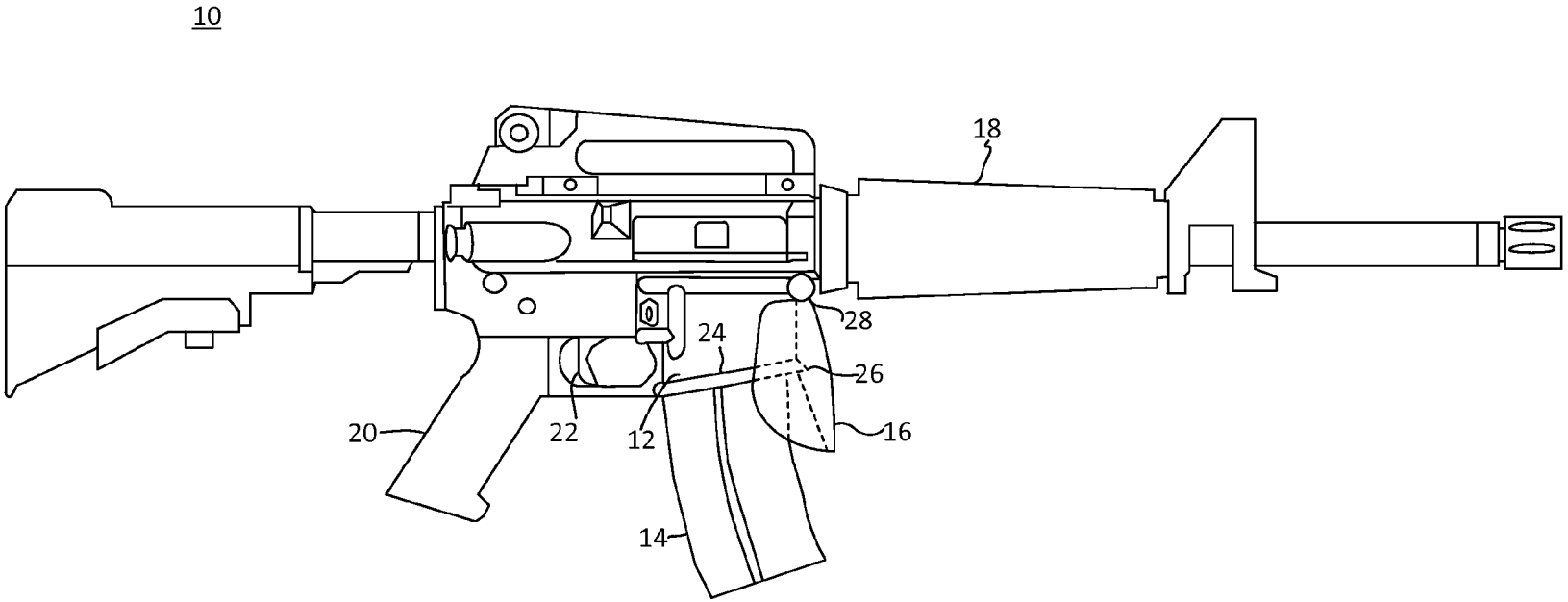
FIG. 1 is a side view of an AR type rifle including a magazine well grip, in accordance with some embodiments.

Those skilled in the field of the present disclosure will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein. The details of well-known elements, structure, or processes that would be necessary to practice the embodiments, and that would be well known to those of skill in the art, are not necessarily shown and should be assumed to be present unless otherwise indicated.

DETAILED DESCRIPTION

Embodiments of the disclosure include a magazine well grip that includes a body. The body includes a front portion and two generally opposing side portions. The side portions taper outward from top to bottom. An upper edge of the body is sized to contact a magazine well on which the magazine well grip is to be mounted. The magazine well grip can further include at least one rib formed on an inner surface of the body at each of the front portion and opposing side portions. These ribs can be configured to contact the magazine well, thereby providing space between the magazine well and the inner surface of the body. The magazine well grip can further include a plurality of retaining features, each formed integrally with a rib on each of the front and side portions, and configured to engage a lip at a lower edge of the magazine well. The magazine well grip can further include a retaining tang that extends upward from the front portion configured to engage the rear of a hinge pin boss and, in cooperation with the plurality of retaining features, retain the magazine well grip on the magazine by interference. The embodiments also include a method of forming a magazine well grip having such features.

As used herein, the term "AR type rifle" refers to all variations of the AR platform, including military and sport/civilian versions of the rifle platform that include a magazine well. Thus, the AR-15, the military M-16 and M-4 rifles, and larger caliber rifles such as the AR-10 rifle, are also included in reference to an AR type rifle for the purposes of this disclosure. Generally, the term "vertical" will refer to an axis between the top and bottom of the drawings, and "horizontal" will refer to an axis between the sides of the page, for side, front, and rear views. Generally, the terms "above" or "upper" will refer to locations closer to the top of the drawing page, while "below" and "lower" will refer to locations closer to the bottom of the drawing page. Thus, when viewing the elements described herein, whether in the drawings or an actual physical specimen, the orientation and terms of relation used herein apply.

FIG. 1 is a side view of an AR type rifle 10 including a magazine well grip 16, in accordance with some embodiments. The AR type rifle generally includes a lower receiver portion that includes a magazine well 12 into which a magazine 14 is inserted. The magazine 14 holds rounds of ammunition which was biased upwards, towards an upper receiver portion of the AR type rifle by a spring inside the magazine 14. The magazine well 12 includes retaining features for retaining the magazine 14 once inserted into the magazine well 12. The magazine well 12 has a lower edge that includes a lip 24, which extends slightly outward from the lower edge of the magazine well 12. The magazine well grip 16 mounts, and is retained on a front portion of the magazine well (here, "front" refers to the direction closest to the muzzle of the rifle). The magazine well grip 16 includes retaining features 26 that interfere with the lip 24, and with a hinge pin boss 28 formed in the upper receiver. Specifically, a protrusion from the top of the magazine well grip 16 sits between the hinge pin boss 28 of the upper receiver and the front of the magazine well 12 of the lower receiver, as will be shown in more detail. The magazine well grip 16 allows an operator of the AR type rifle 10 to grip hold the magazine well grip 16 without imparting any undue force to the magazine 14, and is an alternate gripping location to the handguard 18. In some embodiments a strap or retaining band can be used to further retain the magazine well grip 16 in place, and the strap or band can traverse behind the magazine well 12, through the trigger guard where trigger 22 is located, to the other side of the magazine well grip. The operator's other hand, the trigger hand, grasps the pistol grip 20 and is used to operate the trigger 22. Thus, gripping with the non-trigger hand at the magazine well grip 16 allows a reduced pivot radius between the trigger hand and the non-trigger hand compared to gripping the non-trigger hand at the handguard 18, which is useful in some circumstances.

FIGS. 2-5 show various views of a magazine well grip in accordance with some embodiments where like reference numerals are carried forward through the description of the drawings.

Figure 2:
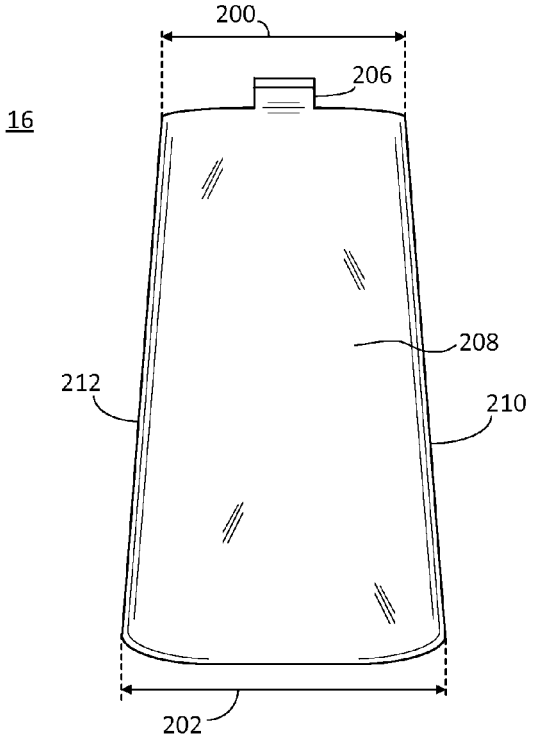
FIG. 2 is a front elevational view of a magazine well grip, in accordance with some embodiments.

FIG. 2 is a front elevational view of a magazine well grip, in accordance with some embodiments. The top of the magazine well grip 16 has a body having a width 200 that is narrower than the width 202 at the bottom of the body of the magazine well grip 16 due to the generally opposing sides 210, 212 angling away from each other from top to bottom. This shape helps to retain a user's hand when the magazine well grip is gripped, and prevent the user's hand from sliding downward. The body of the magazine well grip 16 includes a front portion 208 that traverses between the generally opposing sides 210, 212. The front portion 208 can be convex shaped both horizontally and vertically to conform to the shape of a user's hand when gripping the magazine well grip 16. That is, when a user grips the magazine well grip 16, generally, the user's palm will be on one of the opposing sides 210 or 212, with the user's finger tips on the other side 212 or 210, and the part of the user's hand where the fingers join the palm will be curled around the front portion 208. When so held, the user's hand naturally forms a pocket that is generally concave in both the horizontal and vertical directions. Thus, by forming the front portion 208 to be convex in both the horizontal and vertical direction, an ergonomic fit with the user's natural hand shape is achieved. The magazine well grip also includes a protrusion or retaining tang 206 that protrudes upwards from a top portion of the body that is configured to engage an outer portion of a hinge feature of the upper receiver. Generally, the upper receiver is aligned over the magazine well which, in conjunction with the retaining features, holds the magazine well grip 16 in place on the magazine well. The magazine well grip 16 can be formed of a polymeric material by injection molding.

Figure 3:
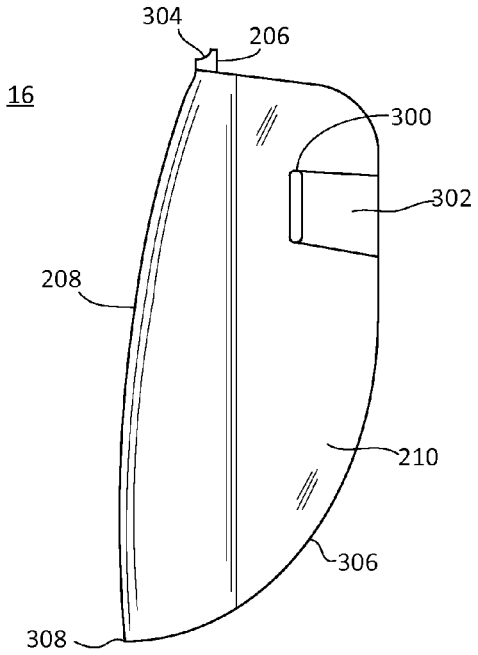
FIG. 3 is a side elevational view of a magazine well grip, in accordance with some embodiments.

FIG. 3 is a side elevational view of a magazine well grip, in accordance with some embodiments. The retaining tang 206 protrudes upwards from the body of the magazine well grip 16, and includes a cutout 304 so as to allow placement behind the hinge pin boss of the upper receiver. Further, in this view the front portion 208 can be seen having a convex shape in the vertical direction, in accordance with some embodiments. Side 210 can include a strap slot 300 and a strap cutout 302 for accepting a retaining strap. Side 212, which is behind side 210 in this view, would have a corresponding strap slot and strap cutout in embodiments where a retaining strap is used. The rear edge 306 of the side 210 (and the corresponding rear edge of side 212) is arced from the rear downward to the front lower edge 308. The arc of the read edge is ergonomically designed to generally conform to a user's palm, such that the thenar and hypothenar muscles of the hand are behind the rear edge 306, which provides purchase so as to be retained in the user's gripping hand.

Figure 4:
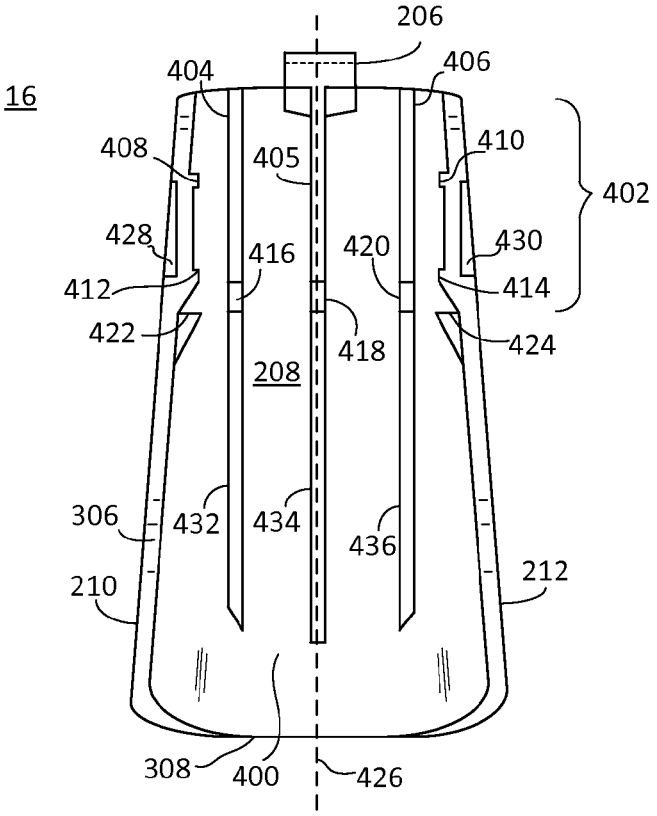
FIG. 4 is a rear elevational view of a magazine well grip, in accordance with some embodiments.

FIG. 4 is a rear elevational view of a magazine well grip 16, in accordance with some embodiments. While the exterior or outer surface of the magazine well grip 16 is generally smooth (although it may include rough texturing for enhanced gripping) and can be ergonomically shaped, the interior includes many features for retaining the magazine well grip 16 on the magazine well, while allowing space between the inner surface 400 of the magazine well grip 16 and the exterior of the magazine well (not shown). In general, one or more ribs are formed on the interior surface of the front portion 208 and each of the generally opposing sides 210, 212. These ribs provide space between the interior surface 400 of the magazine well grip 16 and the exterior surface of the magazine well. The space allows for some air flow between the magazine well grip 16 and the magazine well, but also allows the exterior dimensions to be ergonomic without filling the volume with material, which would increase its weight, and in applications even a reduction in weight by a few grams can be desirable. Thus, the ribs interface with the exterior portion of the magazine well.

In some embodiments, for example, several ribs having upper portions 404, 405, and 406 can be disposed in the inner surface 400 of the front portion 208, can they can be oriented vertically. Retaining features 416, 418, and 420, respectively, and be formed in the ribs between upper portions 404, 405, 406, and lower portions 432, 434, 436. The retaining features 416, 418, 420 are formed to accept the lip 24 at the lower edge of the front portion of the magazine well. The lower portions 432, 434, 436 can be ramp-shaped so as to facilitate guiding a magazine into the magazine well upon inserting the magazine into the magazine well by preventing the magazine from catching on the bottom edge of the magazine well. Note that the tip 435 of the lower portion 434 extends rearward past the front plane of the front of the magazine well 606 and ends at the inner edge of the lip 604.

The side portions or side walls 210, 212 likewise each have one or more ribs, such as ribs 408, 412 on the inner surface of side portion 210, and ribs 410, 414 on the inner surface of side portion 212. Ribs 408, 410, 412, and 414 are generally horizontal, and not parallel to the ribs formed in the inner surface of the front portion 208 in the present example. A retaining feature is likewise formed in ribs 412, 414, and includes a notch and corresponding shoulder portion 422, 424, respectively, for accommodating the lip at the lower edge of the magazine well at the sides of the magazine well. Thus, the upper portions 404, 405, 406 of the ribs on inner surface of the front portion 208, and ribs 408, 410, 4102, 414 make contact with the outer surface of the magazine well, leaving a space between the outer surface of the magazine well and the inner surface 400 of the magazine well grip 16, which provides the advantage of insulating the magazine well grip 16 from the magazine well, as well as eliminating weight that would otherwise be present were the inner surface 400 of the magazine well instead formed to directly accommodate the magazine well.

Figure 5:
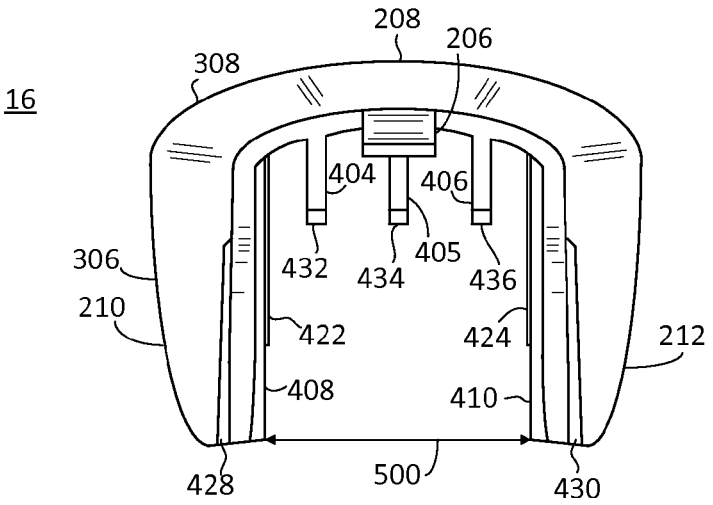
FIG. 5 is a top view of a magazine well grip, in accordance with some embodiments.

FIG. 5 is a top view of a magazine well grip 16, in accordance with some embodiments. From this view it can be seen that the front portion 208 can be convex in the horizontal direction as well as in the vertical direction. The features shown and described in FIG. 4 can likewise be seen in FIG. 5 from the top perspective.

Figure 6:
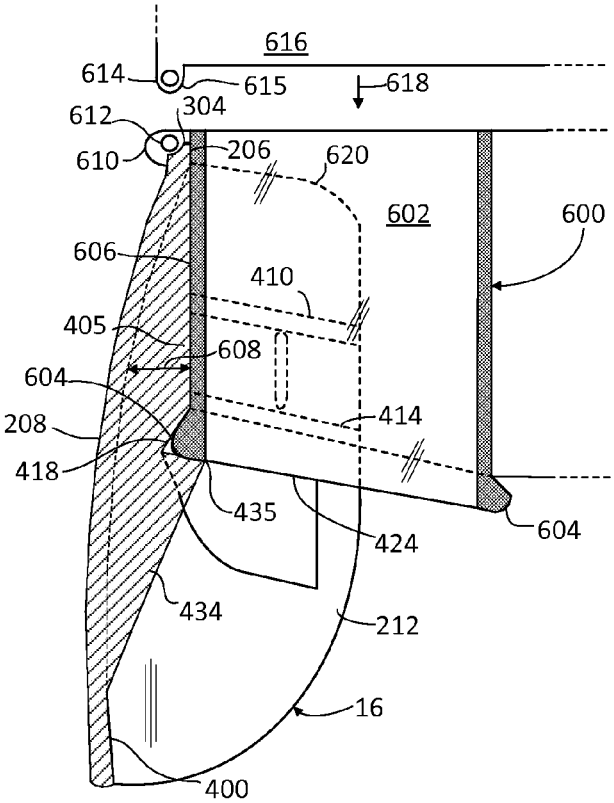
FIG. 6 is a side cut away view of a magazine well grip mounted on a magazine well of an AR type rifle, in accordance with some embodiments.

FIG. 6 is a side cut away view of a magazine well grip 16 mounted on a magazine well 600 of an AR type rifle, in accordance with some embodiments. The cutaway view is cross sections along line 426 of FIG. 4, and looking from the left in that drawing. The magazine well 600 has an interior 602 into which a magazine is inserted and retained. The lower edge of the magazine well 600 includes a lip 604 that circumscribes the bottom of the magazine well 600. At the front side 606 of the magazine well 600 it can be seen that the lip 604 engages the retaining feature 418 formed between the upper portion 405 and the lower portion 434 of the rib. The upper portion 405 spans the space 608 between the inner surface of the front portion 208 and the front 606 of the magazine well 600. The shoulder 424 interfaces with the bottom of the lip 604 so as to retain the lip 604 at the side portion 212. Ribs 410, 414 makes contact with the exterior surface of the magazine well, allowing space between the exterior surface of the magazine well and the inner surface 400 of the magazine well grip 16 around the ribs 410, 414. The top edge 620 of the side portion 212 also contacts the exterior surface of the magazine well, as does the corresponding upper edge of the side 210, which is not seen here.

The lower receiver further includes pair of trunnions such as trunnion 610, which include a hinge pin hole 612. The hinge pin boss 614 of the upper receiver 616 aligns between the trunnions 610 when placed on the lower receiver, as indicated by arrow 618, so that a hinge pin can pass through the trunnions 610 and the hinge pin boss 416 to retain the upper and lower receivers together. The retaining tang 206 extends behind the hinge pin boss 614 such that the cutout 304 makes contact with a back portion 615 of the hinge pin boss 614 when the upper and lower receivers are mated. The dimensions between the retention tang 206 and the retention features integrally formed in the ribs (e.g. 418) is such that there is a slight compression to eliminate play or looseness. Accordingly, the retention tang 206 prevents the top of the magazine well grip 16 from pivoting forward, and the ribs 412, 414, by interference with the lip 604, prevent the bottom of the magazine well from pivoting forward thereby retaining the magazine well grip 16 on the magazine well 600.

Figure 7:
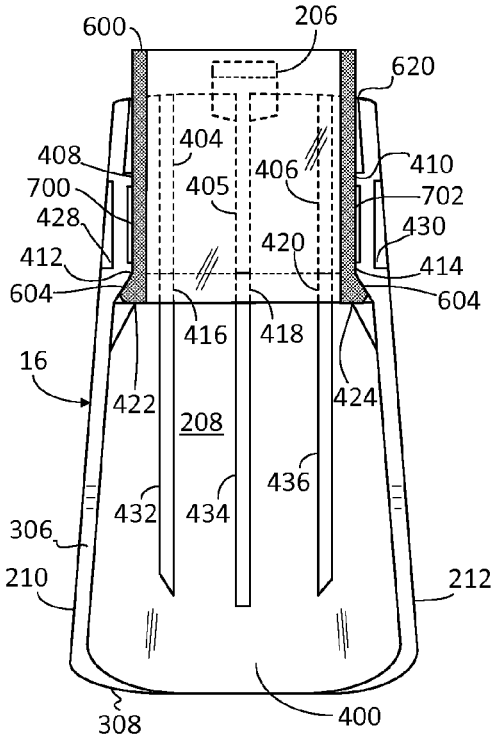
FIG. 7 is a rear cut away view of a magazine well grip mounted on a magazine well of an AR type rifle, in accordance with some embodiments.

FIG. 7 is a rear cut away view of a magazine well grip 16 mounted on a magazine well 600 of the lower receiver for an AR type rifle, in accordance with some embodiments. In this view it can be seen that ribs 408, 410, 412, and 414, and the upper edge 620 of the magazine well grip 16 make contact with the magazine well 600. Ribs 408, 412 form space 700 and ribs 410, 414 form space 702. Spaces 700, 702 allow for a retention strap to pass between the inner surface of the magazine well grip and the magazine well 600. The lip 604 is retained on the sides 210, 212 between rib 412 and shoulder 422, and rib 414 and shoulder 424. As can be seen here, as in FIGS. 2 and 4, the sides angle away from each other from top to bottom, making the bottom of the magazine well grip 16 wider than the top.

Figure 8:
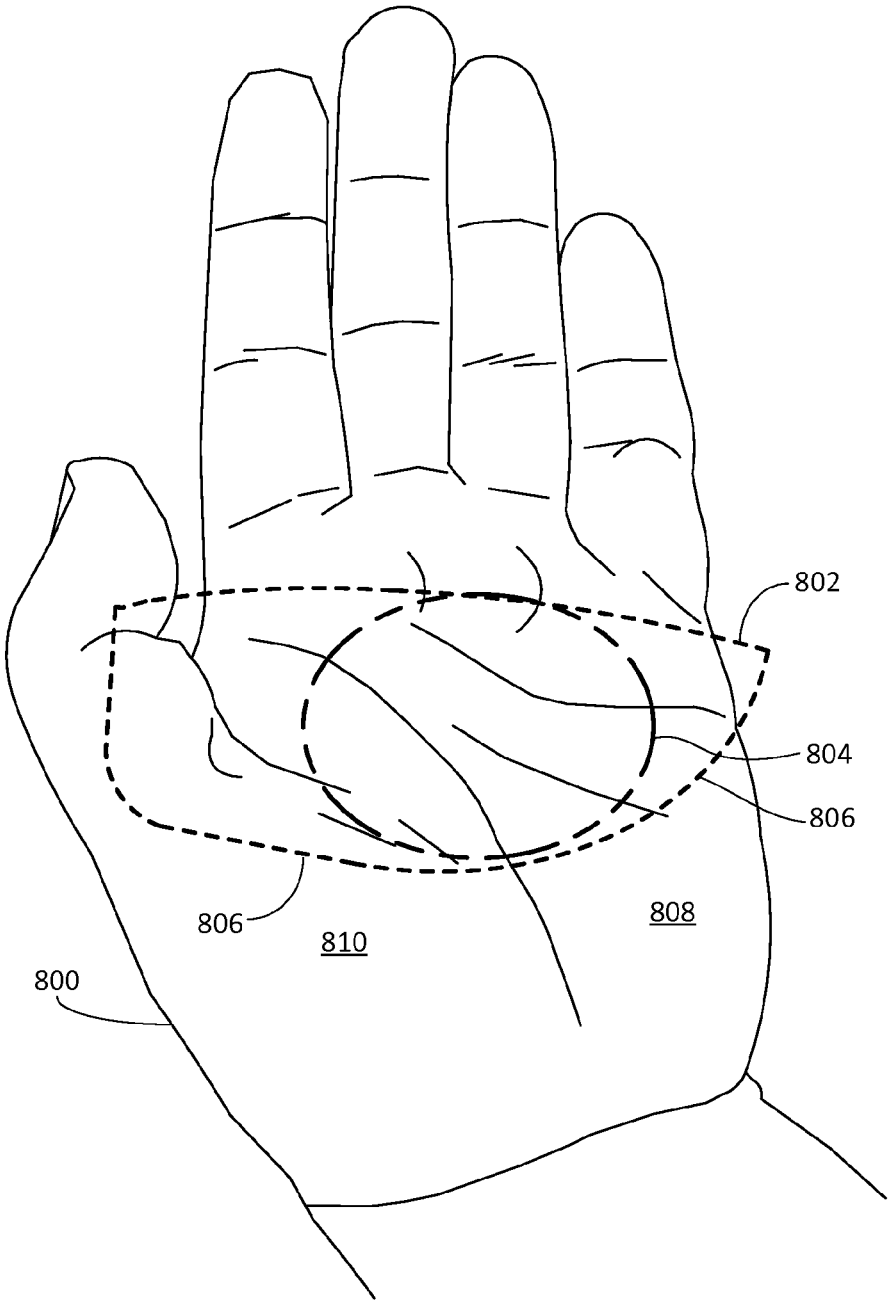
FIG. 8 shows an outline of a magazine well grip against the palm of a hand to illustrate the ergonomic design of the magazine well grip, in accordance with some embodiments.

FIG. 8 shows an outline of a magazine well grip 802 against the palm of a hand 800 to illustrate the ergonomic design of the magazine well grip 802, in accordance with some embodiments. The magazine well grip 802 is shown from a side view perspective with the front of the magazine well grip 802 towards the fingers, and one side against the palm of the hand 800. The fingers of the hand 800 are open, and not grasping the magazine well grip 802. As shown, the magazine well grip 802 could be mounted on a magazine well (not shown), but the drawing is intended to show the shape of the magazine well grip relative to a user's hand 800. The hand 800 includes a middle palm region 804, which lacks muscle. The middle palm region 804 is adjacent to the thenar muscles 810 and the hypothenar muscles 808. The rear edge 806 of the magazine well grip is arced to approximate the curve formed between the middle palm 804 and the hypothenar muscles 808 when grasped. Also, the dimension of the sides of the magazine well grip 802, from the front (towards the fingers) to the back edge 806, and the widening of the magazine well grip 802 from top to bottom can allow for the rear edge 806 to rest against the thenar and hypothenar muscles by depressing into the palm which can aid in gripping the magazine well grip 802.

Figure 9:
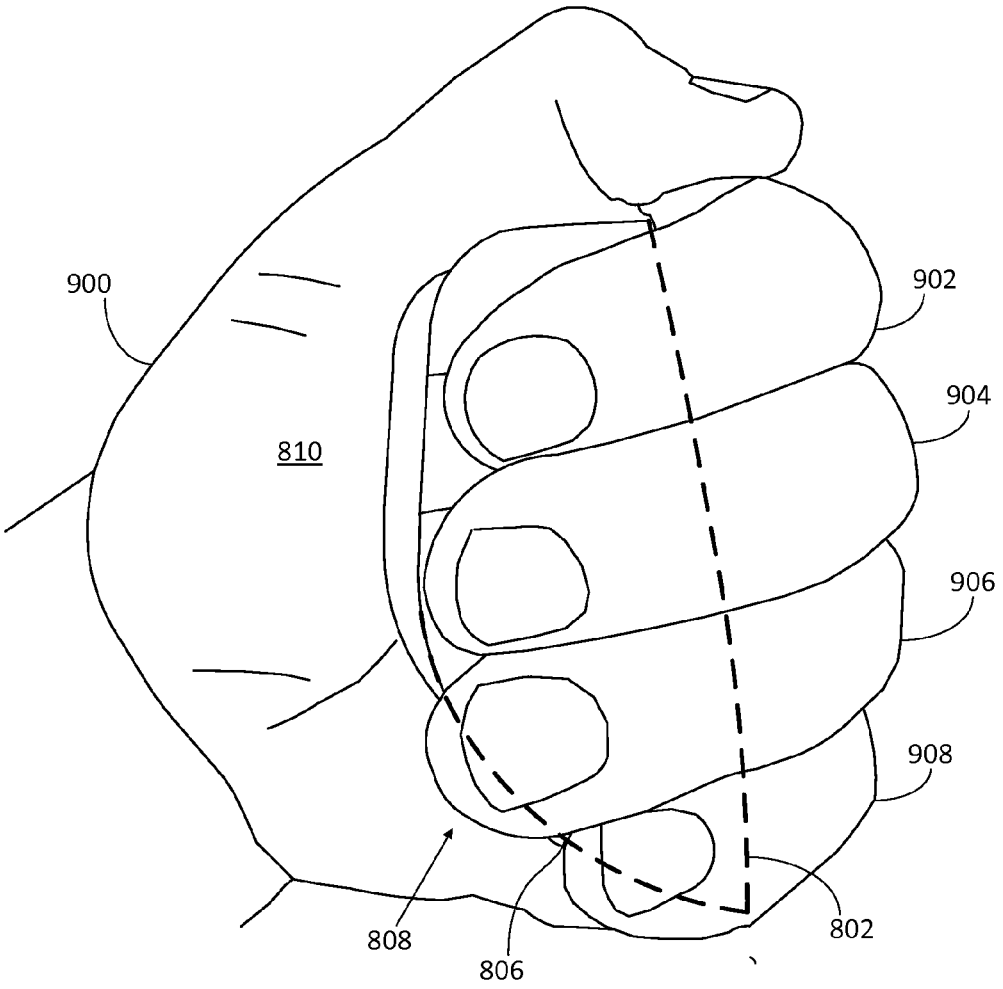
FIG. 9 shows a magazine well grip being grasped by a hand, in accordance with some embodiments.

FIG. 9 shows a magazine well grip being grasped by a hand, in accordance with some embodiments. In this view the hand 900 is grasping the magazine well grip 802, with fingers 902-908 wrapped around the front of the magazine well grip 802 and the near (to the viewer) side of the magazine well grip. The far side of the magazine well grip 802 is slightly pressed into the palm, with the read edge 806 following, generally, the curve of the muscles in the palm of the hand 900. Likewise, the fingers extend around the near side of the magazine well grip 802 with the finger tips forming, generally, and arc that is approximated by the arc of the rear edge 806 of the near side of the magazine well grip 802. The arced shape of the rear edge further eliminates unnecessary material, as would be the case if the sides of the magazine well grip 802 extended farther back or even surrounded the magazine well, which avoids additional and unnecessary weight while providing an affirmative ergonomic grip.

Figure 10:
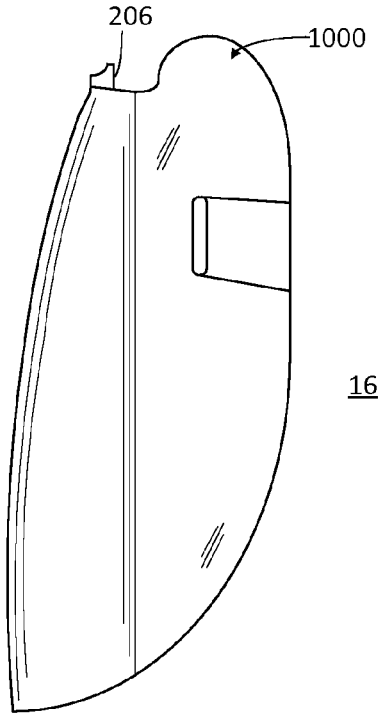
FIG. 10 shows a magazine well grip having a thumb extension, in accordance with some embodiments.

FIG. 10 shows a magazine well grip 16 having a thumb extension 1000, in accordance with some embodiments. The thumb extension 1000 can be formed on one or both sides of the magazine well grip 16, and provides an alternate location for placement of a user's thumb when gripping the magazine well grip 16. Generally, the thumb extension 1000 is an extension of a side above the level of the retention tang 206. In some embodiments it can include a slight depression in the middle of the extension 1000 that is generally sized and shaped to accommodate the side of a typical thumb.

Figure 11:
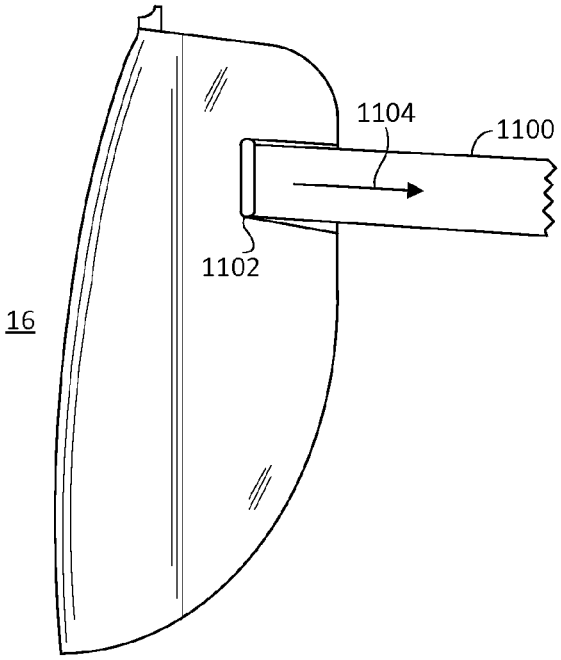
FIG. 11 shows a magazine well grip using a band or strap for additional retention on a magazine well, in accordance with some embodiments.

FIG. 11 show a magazine well grip 16 using a band or strap 1100 for additional retention on a magazine well, in accordance with some embodiments. The strap 1100 can be placed through a strap slot 1102 (also, e.g. 300 in FIG. 3) and can traverse between the magazine well and the inner surface of the magazine well grip, such as, for example, between ribs 408, 412, and 410, 414 of FIGS. 4 & 7. The strap 1100 can be a fastened using conventional hook and loop material, and pulls on the magazine well grip 16 in the direction of arrow

1104 to further retain the magazine well grip 16 on a magazine well. The strap 1100 can go around the magazine well, through the trigger guard or trigger well without interfering with operation of the trigger.

Accordingly, the various embodiments provide a magazine well grip that is ergonomically contoured while minimizing the weight of the material. The exterior of the magazine well grip is sized to comfortable accommodate a user's hand when gripped, and provides features that enhance grip. Weight is reduced by spacing the inner surface of the magazine well grip away from the magazine well, and using ribs, rather than the inner surface of the magazine well grip, that contact the magazine well to stabilize the magazine well grip. Retention features retain the magazine well grip in place by taking advantage of an interference fit formed between the retention tang and the retention features that engage the lip of the magazine well. The magazine well grip is further ergonomically shaped by the taper shape of the bottom being wider than the top, from side to side, which aids in gripping the magazine well grip. Various alterations will occur to those skilled in the art without departing from the scope of claimed invention. For example, although exemplified in some of the drawings using vertical ribs on the inner surface of the front portion, horizontal ribs could likewise be used in the upper portion, as is shown on the sides. However, the lower portions of the ribs in the front portion, which form ramps to guide magazine insertion, would still preferably be present. Furthermore, in some embodiments, the front portion may not be convex shaped in the vertical direction, and may be flat, relaying on the tapered shape for grip retention. Still further, the embodiments include a method of forming a magazine well grip in accordance with the various exemplary embodiments and their alternatives. This would include, for example, computer software or data used to configure machines in manufacturing a magazine well grip in accordance with any of the embodiments.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

Moreover, an embodiment can be generated using a computer-readable storage medium having computer readable code stored thereon for programming a computer (e.g., comprising a processor) to perform a method as described and claimed herein for manufacturing a magazine well grip. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description as part of the original disclosure, and remain so even if cancelled from the claims during prosecution of the application, with each claim standing on its own as a separately claimed subject matter. Furthermore, subject matter not shown should not be assumed to be necessarily present, and that in some instances it may become necessary to define the claims by use of negative limitations, which are supported herein by merely not showing the subject matter disclaimed in such negative limitations.

I claim:

1. A magazine well grip for an rifle, comprising:

a body configured to cover a front portion of a magazine well and having a front portion and generally opposing side portions extending rearward from the front portion and which generally angle away from each other towards a bottom of the magazine well grip, the body further having an inner surface and an outer surface, and wherein the front and generally opposing side portions extend below a lower edge of the magazine well;

at least two ribs disposed on the inner surface at a top portion of the body at the front portion and each of the generally opposing side portions, and that are configured to contact the magazine well and between the magazine well and the inner surface;

retaining features formed integrally with the at least two ribs to engage a lip at the lower edge of the magazine well; and a retaining tang protruding upwards from a top portion of the body and configured to engage an outer portion of a hinge feature of an upper receiver aligned over the magazine well which, in conjunction with the retaining features, holds the magazine well grip in place on the magazine well.

2. The magazine well grip of claim 1, wherein the front portion of the body is convex horizontally and vertically.

3. The magazine well grip of claim 1, wherein the at least two ribs on the inner surface of the front portion are generally vertical and ramped.

4. The magazine well grip of claim 3, wherein the retaining features formed integrally in the at least two ribs on the inner surface of the front portion are notches, and wherein the at least two ribs continue below the notches and ramp down to form a magazine guide feature.

5. The magazine well grip of claim 1, wherein the generally opposing side portions have a back edge that is arced to the front portion at a bottom of the back edges.

6. The magazine well grip of claim 5, wherein the arced portion is generally arced in accordance with an outer edge of a middle palm portion of a hand when gripping the magazine well grip.

7. The magazine well grip of claim 1, further comprising a slot formed in each of the generally opposing side portions configured to accommodate a retaining strap between the magazine well grip and the magazine well.

8. The magazine well grip of claim 1, further comprising a thumb extending from at least one of the generally opposition side portions configured to accommodate a user's thumb when gripping the magazine well grip.

9. A magazine well grip, comprising:

a body having a front portion and two generally opposing side portions, wherein the sides taper outward from top to bottom, and wherein an upper edge of the body is sized to contact a magazine well on which the magazine well grip is to be mounted;

at least one rib formed on an inner surface of the body at each of the front portion and opposing side portions configured to contact the magazine well, thereby providing space between the magazine well and the inner surface of the body;

a plurality of retaining features, each formed integrally with the at least one rib on each of the front and side portions configured to engage a lip at a lower edge of the magazine well; and a retaining tang that extends upward from the front portion configured to engage the rear of a hinge pin boss and, in cooperation with the plurality of retaining features, retain the magazine well grip on the magazine by interference.

10. The magazine well grip of claim 9, wherein the at least one rib on the inner surface of the front portion is three vertically formed ribs each having an upper portion configured to contact the magazine well, and a lower portion that form ramps to an inner edge of the lip.

11. The magazine well grip of claim 9, wherein the outer surface of the front portion is convex shaped in the both the vertical and horizontal directions.

12. The magazine well grip of 9, wherein the opposing side portions each have a rear edge that is arced towards a bottom of the front portion.

13. The magazine well grip of claim 12, wherein the rear edge of the side portions are arced generally in conformance with a middle palm portion of a hand.

14. The magazine well grip of claim 9, further comprising a thumb extension formed on at least one of the side portions that extends upward from the side portion to accommodate a user's thumb upon gripping the magazine well grip.

15. The magazine well grip of claim 9, further comprising a strap slot formed in each of the side portions.

16. A method of forming a magazine well grip, comprising:

forming a body having a front portion and two generally opposing side portions, including forming the sides so as to taper outward from top to bottom, and wherein the body is formed such that an upper edge of the body is sized to contact a magazine well on which the magazine well grip is to be mounted;

forming at least one rib formed on an inner surface of the body at each of the front portion and opposing side portions configured to contact the magazine well, thereby providing space between the magazine well and the inner surface of the body;

forming a plurality of retaining features, each formed integrally with the at least one rib on each of the front and side portions configured to engage a lip at a lower edge of the magazine well; and forming a retaining tang that extends upward from the front portion configured to engage the rear of a hinge pin boss and, in cooperation with the plurality of retaining features, retain the magazine well grip on the magazine by interference.

17. The method of claim 16, wherein forming the at least one rib comprises forming, on the inner surface of the front portion, three vertically formed ribs, each having an upper portion formed to contact the magazine well, and a lower portion that form ramps to an inner edge of the lip.

18. The method of claim 16, wherein forming the body comprises forming the outer surface of the front portion in a convex shape in the both the vertical and horizontal directions.

19. The method of claim 16, wherein forming the body comprises forming the opposing side portions to each have a rear edge that is arced towards a bottom of the front portion.

20. The method of claim 19, wherein forming the body comprises forming the rear edge of the side portion to be arced generally in conformance with a middle palm portion of a hand.

* * * * *